US010631607B2

(12) United States Patent
Yu

(10) Patent No.: US 10,631,607 B2
(45) Date of Patent: Apr. 28, 2020

(54) LUGGAGE WITH STUD-HOOK

(71) Applicant: Olympia International, Inc., Torrance, CA (US)

(72) Inventor: Chris Yu, Torrance, CA (US)

(73) Assignee: Olympia International, Inc., Torrance, CA (US)

( * ) Notice: Subject to any disclaimer, the term of this patent is extended or adjusted under 35 U.S.C. 154(b) by 128 days.

(21) Appl. No.: 15/938,923

(22) Filed: Mar. 28, 2018

(65) Prior Publication Data

US 2018/0279730 A1 Oct. 4, 2018

Related U.S. Application Data

(60) Provisional application No. 62/478,551, filed on Mar. 29, 2017.

(30) Foreign Application Priority Data

Jun. 7, 2017 (KR) ..... 20-2017-0002857 U
Jun. 26, 2017 (CN) ..... 2017 2 0751181 U
Sep. 19, 2017 (CN) ..... 2017 2 1202888 U

(51) Int. Cl.
*A45C 13/00* (2006.01)
*A45C 5/14* (2006.01)
*A45C 15/00* (2006.01)

(52) U.S. Cl.
CPC ..... *A45C 13/001* (2013.01); *A45C 5/14* (2013.01); *A45C 15/00* (2013.01); *A45C 2200/00* (2013.01)

(58) Field of Classification Search
CPC ..... A45C 13/001; A45C 5/14; A45C 15/00; A45C 2200/00
See application file for complete search history.

(56) References Cited

U.S. PATENT DOCUMENTS 5,713,439 A * 2/1998 Zionts ..... A45C 5/14 150/108
5,842,673 A 12/1998 Fenton
10,076,166 B2 * 9/2018 Kim ..... B65D 21/0201
2004/0211634 A1 * 10/2004 Chan ..... A45C 7/0045 190/108

FOREIGN PATENT DOCUMENTS

| | | |
|---|---|---|
| CN | 204949876 | 1/2016 |
| CN | 206866804 | 1/2018 |
| JP | 05093249 | 12/1993 |
| WO | 2007019379 | 2/2007 |

OTHER PUBLICATIONS

PCT International Application No. PCT/KR2018/024893, International Search Report dated Jul. 17, 2018, 9 pages.

* cited by examiner

*Primary Examiner* — Tri M Mai
(74) *Attorney, Agent, or Firm* — Lee, Hong, Degerman, Kang & Waimey

(57) ABSTRACT

A luggage container includes a wheel assembly coupled to a bottom surface of the luggage container, the wheel assembly comprising a wheel; and at least two studs or feet coupled to a side surface of the luggage container. At least one of the at least two studs or feet includes a stud-hook, and the stud-hook is configured to: function as a foot when the luggage container is standing in a first orientation such that the wheel is not in contact with ground; and function as a hook when the luggage container is standing in a second orientation such that the wheel is in contact with the ground.

16 Claims, 6 Drawing Sheets

LUGGAGE WITH STUD-HOOK

CROSS REFERENCE TO RELATED APPLICATIONS

Pursuant to 35 U.S.C. § 119(e), this application claims the benefit of Provisional Application No. 62/478,551 filed on Mar. 29, 2017, and pursuant to 35 U.S.C. § 119(a), this application also claims the benefit of earlier filing dates and right of priority to Korean Patent Application No. 20-2017-0002857, filed on Jun. 7, 2017, Chinese Patent Application No. 201720751181.0, filed on Jun. 26, 2017, and Chinese Patent Application No. 201721202888.2, filed on Sep. 19, 2017, the contents of which are all hereby incorporated by reference herein in their entirety.

BACKGROUND OF THE INVENTION

Field

The present invention relates generally to a luggage container with a built-in stud-hook for hanging an item. More specifically, the present invention relates to a stud of luggage that functions as both a stand foot and a hook.

Background

A challenge to traveling has always been carrying one's belongings in the most efficient and easy manner. When additional items are obtained after luggage had already been packed, it is not easy to re-open the luggage to store the additionally obtained items in the luggage. For example, after shopping in a duty free shop at an airport, it is cumbersome to carry extra shopping bags with purchased items, and trying to open the luggage to store the purchased items in the luggage is even more challenging.

Therefore, a hook may be placed on a side of luggage such that an additional bag such as a shopping bag may be hung at the hook. However, adding a hook to the luggage may require an additional structure. For example, luggage usually has bottom studs or feet 10 attached to a side or bottom of the luggage to protect the luggage from dirt and damage, as shown in FIG. 1. If a hook is attached to the luggage in addition to the bottom studs, it may raise the cost of manufacturing and the hook protruding from the side of the luggage may not look good esthetically because too many elements protrude from the luggage. Therefore, a solution is necessary to avoid the above-identified problems.

SUMMARY OF THE INVENTION

According to one embodiment of the present invention, a luggage container includes a wheel assembly coupled to a bottom surface of the luggage container, the wheel assembly comprising a wheel; and at least two studs or feet coupled to a side surface of the luggage container. At least one of the at least two studs or feet includes a stud-hook, and the stud-hook is configured to: function as a foot when the luggage container is standing in a first orientation such that the wheel is not in contact with ground; and function as a hook when the luggage container is standing in a second orientation such that the wheel is in contact with the ground.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF EMBODIMENTS

Hereinafter, the present invention will be described with respect to the embodiment(s) illustrated in the annexed drawings.

Figure 2A:
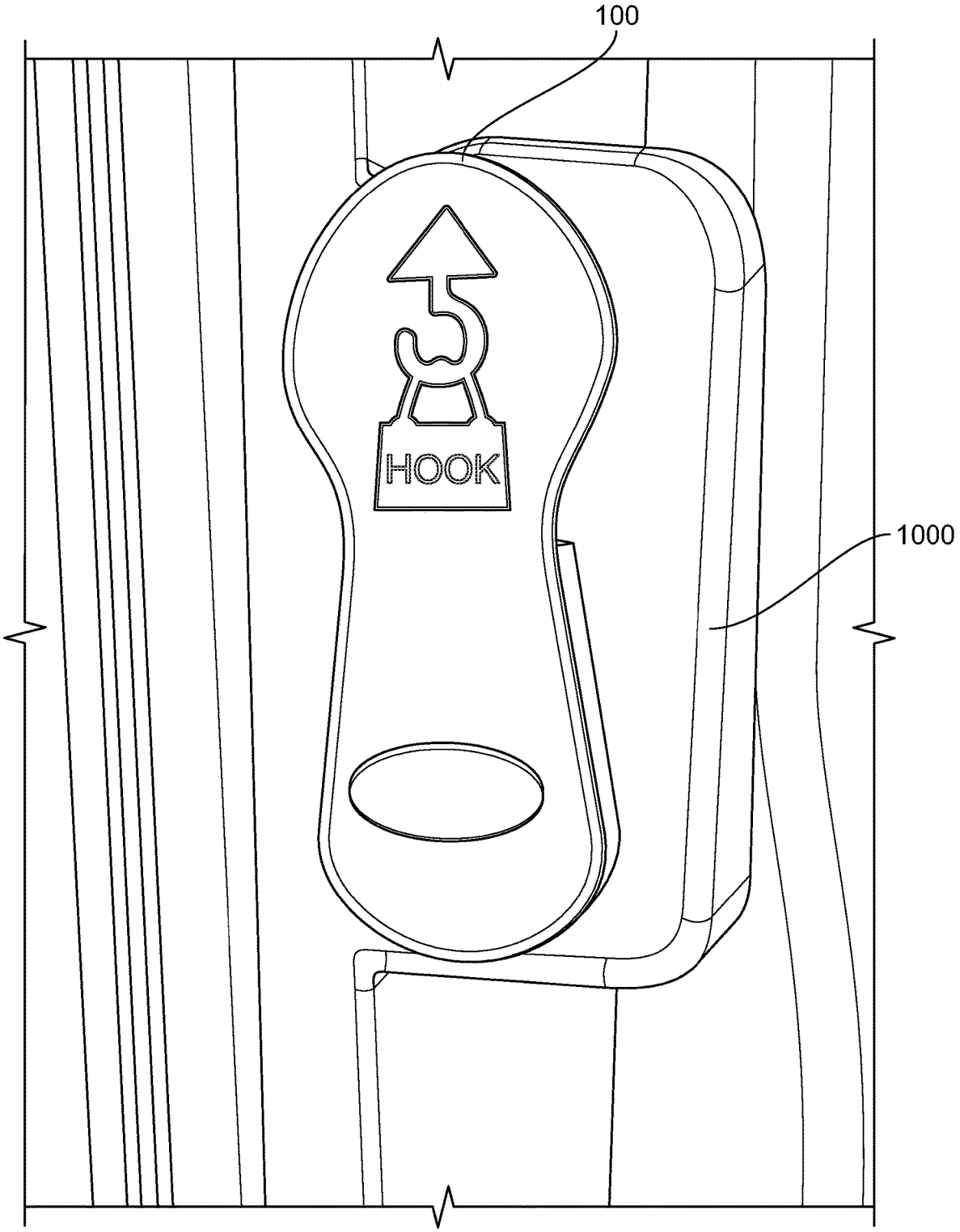
FIGS. 2A and 2B show different views of a stud-hook coupled to a luggage container according to an embodiment of the present invention.
Figure 2B:
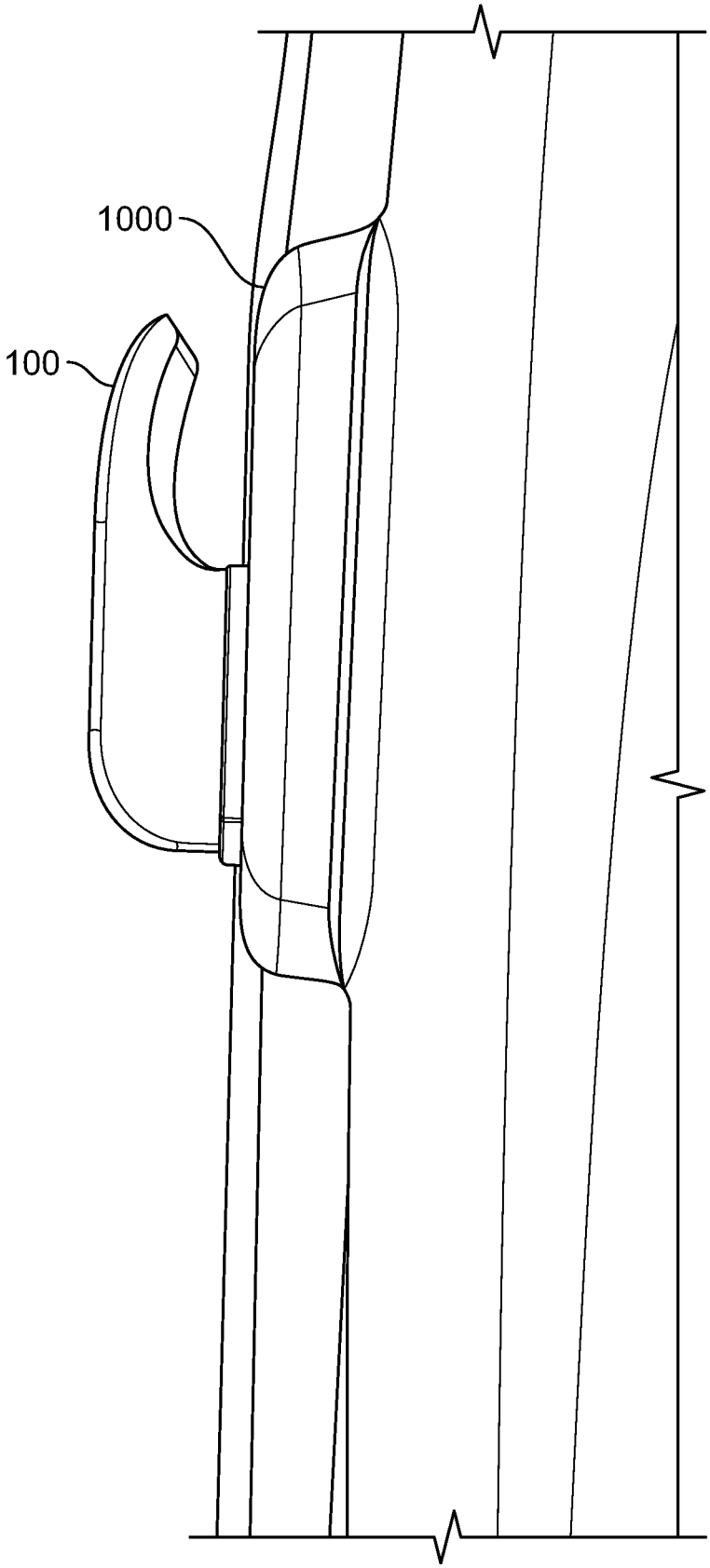

FIGS. 2A and 2B show different views of a stud-hook coupled to a luggage container according to an embodiment of the present invention. Referring to FIGS. 2A and 2B, a stud-hook 100 is coupled to an external surface of a luggage container 1000. For example, the stud-hook 100 is coupled to a side surface of the luggage container 1000 and wheels 20 are coupled to a bottom surface of the luggage container. See FIG. 5A.

The stud-hook 100 includes a main body and a protrusion extendingly formed from the main body. The stud-hook 100 is coupled to the external surface of the luggage container 1000 via the main body and the protrusion does not contact the external surface. The protrusion has an inner side and an outer side. The protrusion is shaped to form a hook when the stud-hook 100 is coupled to the side surface of the luggage container 1000 via the main body. That is, the hook is generated by a gap formed between the side surface and the inner side of the protrusion of the stud-hook 100. For example, a length of the gap may be in the range of 1 mm to 20 mm. Preferably, the length of the gap is in the range of 5 mm to 15 mm. More preferably, the length of the gap is about 10 mm or 1 cm.

In one aspect of the present invention, the stud-hook 100 is attached to the external surface of the luggage container 1000 by an adhesive. In another aspect of the present invention, the stud-hook 100 is coupled to the luggage container 1000 via a hole formed on the luggage container 1000. For example, a fastening means, such as a screw or rivet, passes through the hole of the luggage container 1000 and is fixed to the stud-hook 100 such that the stud-hook 100 is coupled to the external surface of the luggage container 1000.

Figure 1:
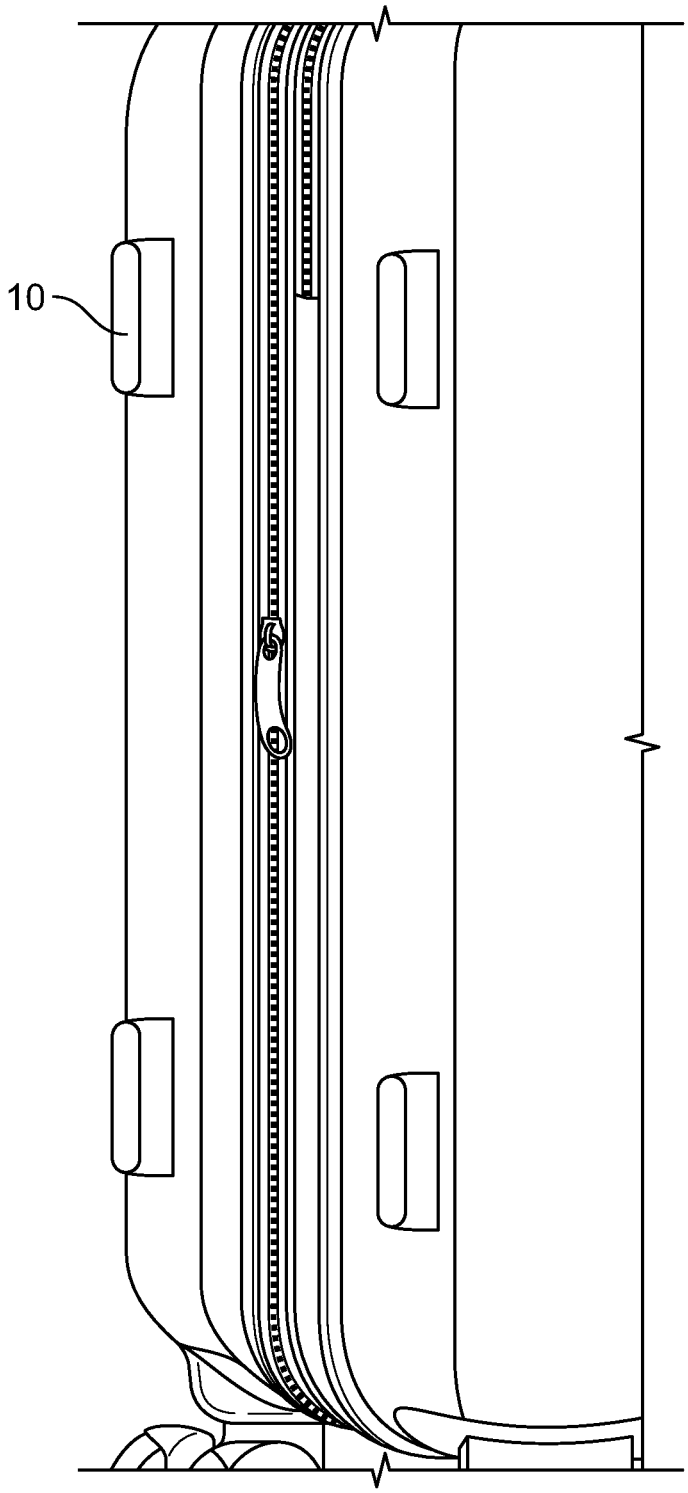
FIG. 1 (Prior Art)
FIG. 1 shows bottom studs attached to a luggage container in the related art.
Figure 5A:
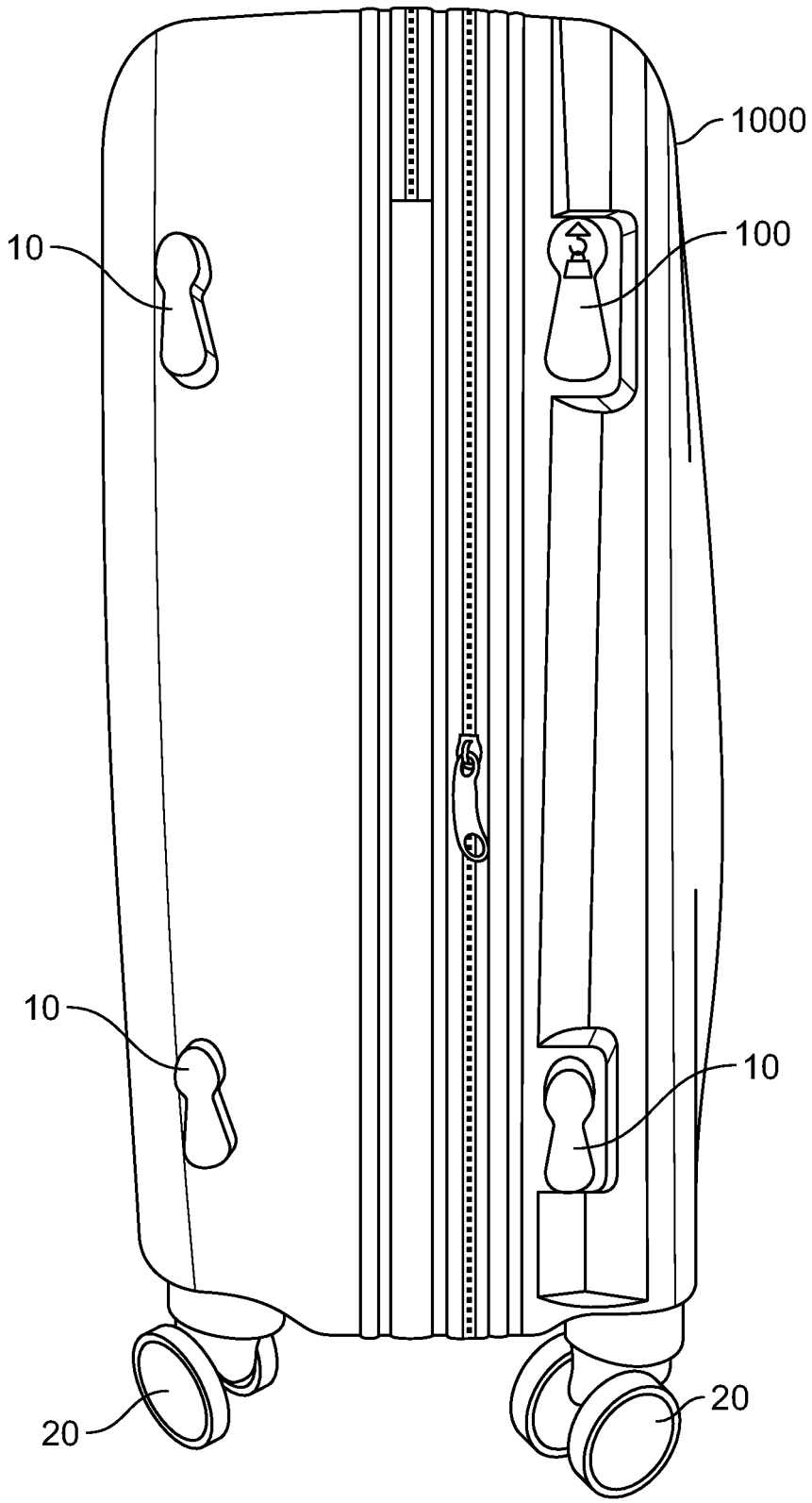
FIGS. 5A and 5B show a luggage container with a stud-hook according to an embodiment of the present invention.

For example, at least one of bottom studs or feet 10 shown in FIG. 1 may be replaced by the stud-hook 100 to arrive at the luggage container 1000 according to an embodiment of the present invention such that the luggage container 1000 may have one or more stud-hook(s) 100 and/or one or more bottom stud(s) 10. For example, see FIG. 5A showing the luggage container 1000 having one stud-hook 100 and three bottom studs 10. The stud-hook 100 may be graphically identified by means of a visual image formed on the stud-hook, as exemplified in FIGS. 2A and 3A. Further, when the stud-hook 100 and bottom studs 10 have similar shapes, the stud-hook 100 may be colored distinguishably from the color of the bottom studs 10 for easy recognition.

Figure 5B:
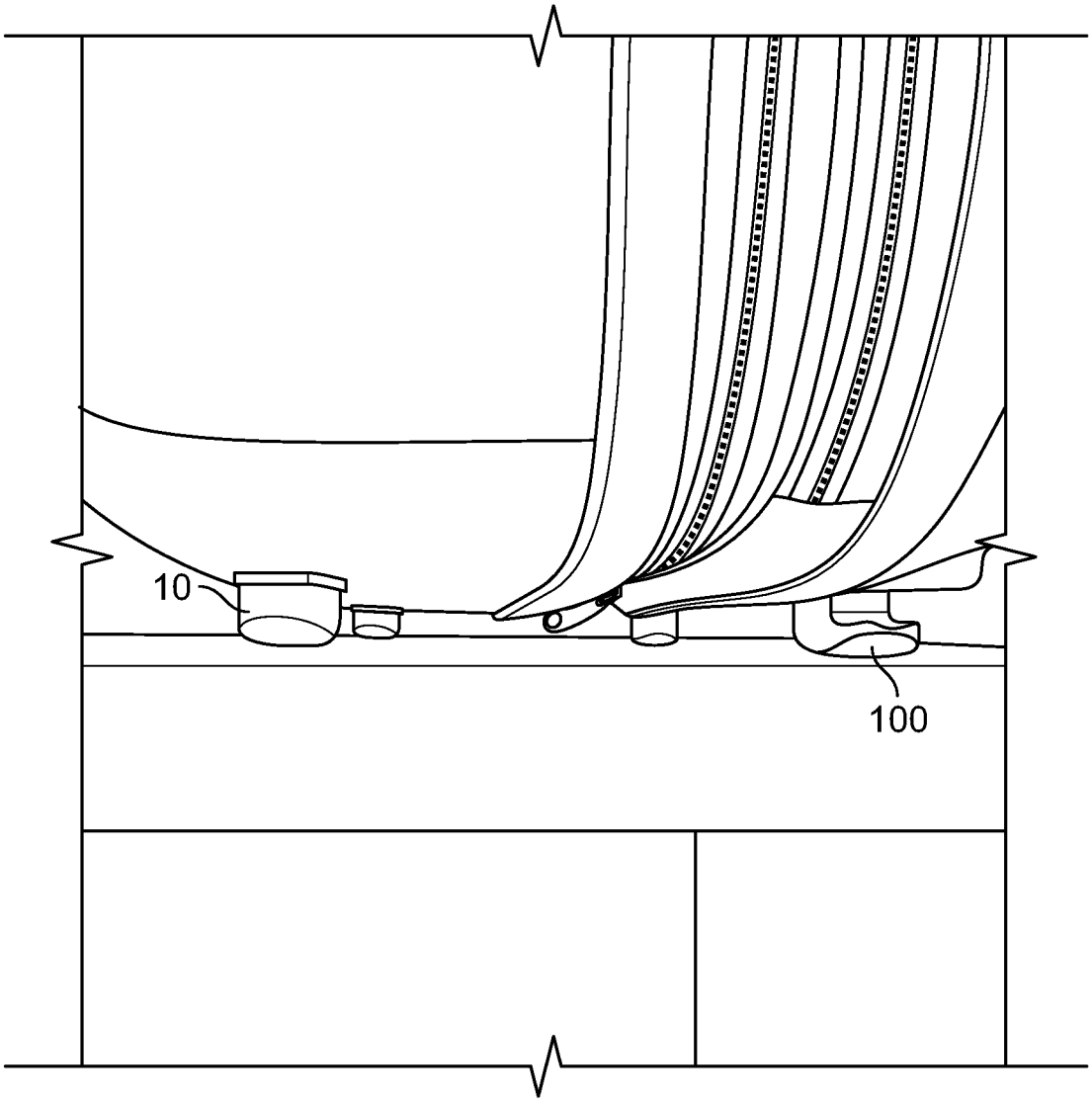

FIGS. 5A and 5B show a luggage container with a stud-hook according to an embodiment of the present invention. In one embodiment of the present invention, the luggage container 1000 may include only stud-hooks 100 without any bottom stud 10. Preferably, the total number of the one or more stud-hook(s) 100 (and one or more bottom stud(s) 10) may be four, i.e., three bottom studs 10 and one stud-hook 100, as exemplified in FIG. 5A. More preferably, one or two of the one or more stud-hook(s) 100 and one or more bottom stud(s) 10 of the luggage container 1000 may be stud-hooks 100. For example, as shown in FIG. 5A, the stud-hook 100 and one bottom stud 10 are located at an upper portion of the luggage container 1000 and two bottom studs 10 are located at a lower portion of the luggage container 1000 when the luggage container 1000 is in an upright position with the wheels 20 contacting the ground.

Although the stud-hook(s) 100 may function as hook(s) when the luggage container 1000 is in the upright position, the stud-hook(s) 100 also functions as bottom stud(s) when the luggage container 1000 is oriented such that the stud-hook(s) 100 is in contact with the ground, as shown in FIG. 5B. When the stud-hook 100 functions as the bottom stud, the outer side of the protrusion of the stud-hook 100 contacts the ground. Although there is only one stud-hook 100 included in the luggage container 1000 exemplified in FIGS. 5A and 5B, when four stud-hooks 100 are coupled to the luggage container 1000, all the stud-hooks 100 will function as bottom studs or feet when the stud-hooks 100 are in contact with the ground.

According to an embodiment of the present invention, the stud-hook 100 is a single piece item as exemplified in FIGS. 2A and 2B. According to another embodiment of the present invention, the stud-hook 100 includes two pieces that are coupled to each other, as exemplified in FIGS. 3A-4B.

Figure 3A:
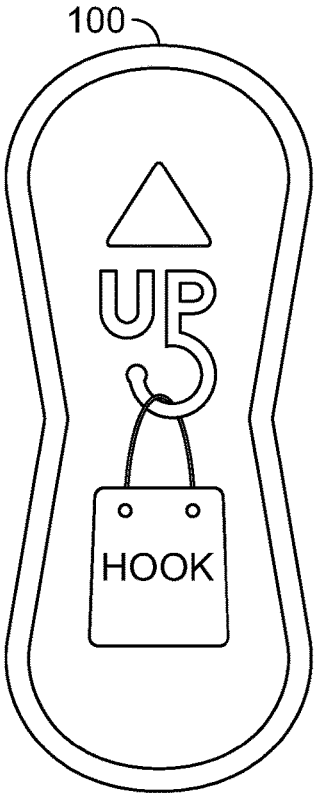
FIGS. 3A and 3B show a variable stud-hook coupled to the luggage container in a stud configuration according to another embodiment of the present invention.
Figure 3B:
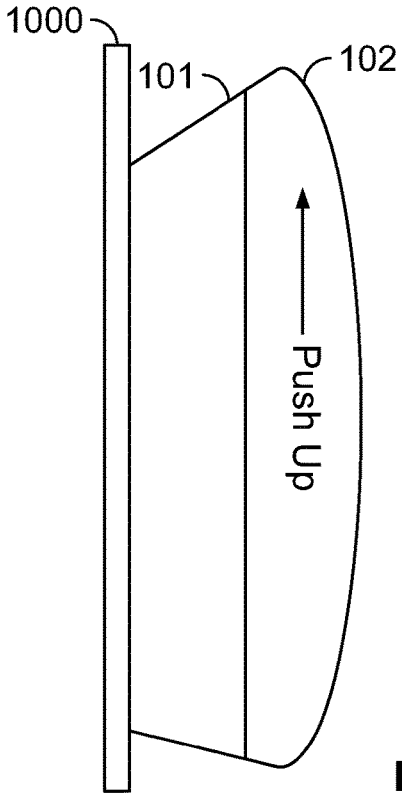
Figure 4A:
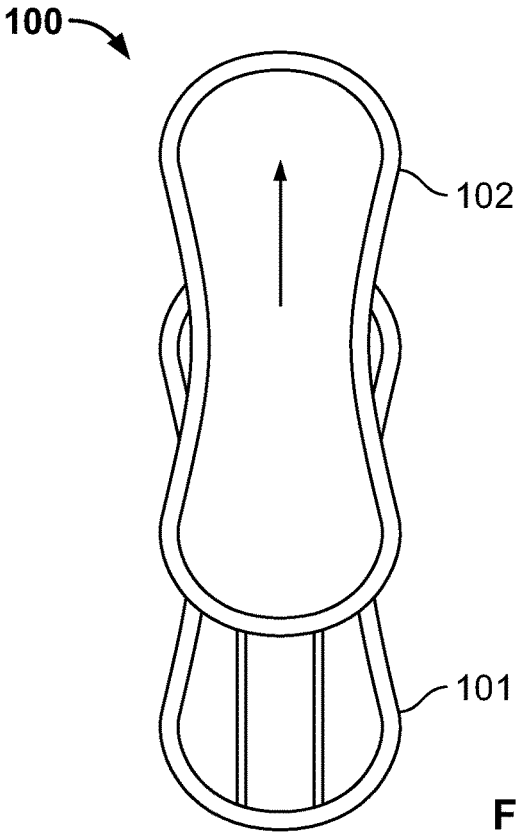
FIGS. 4A and 4B show the variable stud-hook of FIGS. 3A and 3B that is in a hook configuration.
Figure 4B:
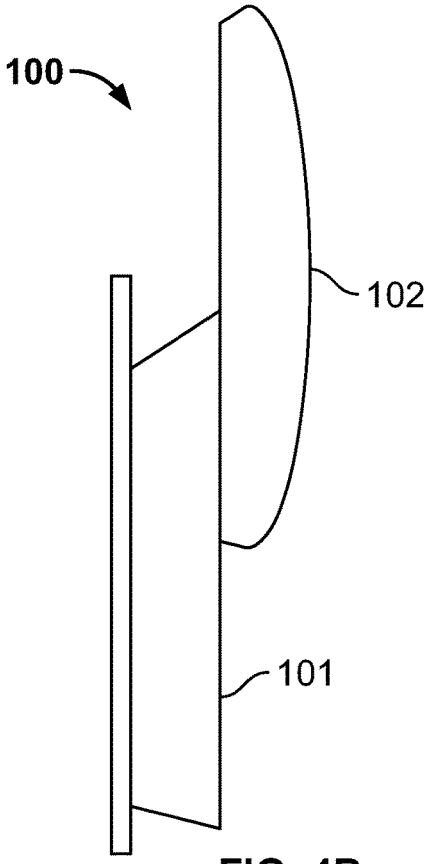

FIGS. 3A and 3B show a variable stud-hook coupled to the luggage container in a stud configuration according to another embodiment of the present invention. FIGS. 4A and 4B show the variable stud-hook of FIGS. 3A and 3B that is in a hook configuration. Referring to FIGS. 3A, 3B, 4A, and 4B, according to another embodiment of the present invention, a stud-hook 100 is configured to be in two different configurations. In FIGS. 3A and 3B, the stud-hook 100 is in a stud configuration and in FIGS. 4A and 4B, the stud-hook 100 is in a hook configuration such that the stud-hook 100 can be in the hook configuration when a hook is necessary. Otherwise, the variable stud-hook 100 may be in the stud configuration when no hook is necessary.

For example, the variable stud-hook 100 includes a bottom portion 101 and a top portion 102, and the top portion 102 is slidable with respect to the bottom portion 101. When the top portion 102 is slid up, the stud-hook 100 is converted from the stud configuration to the hook configuration such that the stud-hook 100 is usable as a hook for hanging stuffs such as a shopping bag, as shown in FIG. 4B. When the hook is no longer necessary, the stud-hook 100 may be switched back to the stud configuration by sliding down the top portion 102.

For example, the top portion 102 is coupled to the bottom portion 101 by being slidably inserted into a grooved rail formed on the bottom portion 101, as shown in FIG. 4A. A sliding mechanism other than the groove rail may be employed for the variable stud-hook 100. Preferably, the stud-hook 100 is made of plastic. However, the stud-hook 100 may be made of other suitable materials.

Those skilled in the art will appreciate that alternative embodiments exist from the above description of the embodiments without departing from the spirit and scope of the invention. The above described embodiments were shown in the context of a standard carry-on size luggage in the drawings. However, in alternative embodiments, a full size luggage or a luggage with additional compartments can be substituted for the described luggage. In addition, luggage may be made with any material that is suitable.

Therefore, the foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the apparatus of the invention. Since many embodiments of the invention can be made without departing from the spirit and scope of the invention, the invention resides in the claims hereinafter appended.

What is claimed is:

1. A luggage container comprising:

a wheel assembly coupled to a bottom surface of the luggage container, the wheel assembly comprising a wheel; and four studs or feet coupled to a narrow side surface of the luggage container having two parallel narrow side surfaces including the narrow side surface and two parallel wide side surfaces, the narrow side surfaces and the wide side surfaces being perpendicular to the bottom surface, and an area of the wide side surfaces being wider than an area of the narrow side surfaces, wherein at least one of the four studs or feet comprises a single piece stud-hook comprising a main body and a protrusion extendingly formed from the main body such that the stud-hook is coupled to the narrow side surface via the main body and a gap is formed between the side surface and an inner side of the protrusion, and wherein the stud-hook shaped to form a hook for hanging an object is configured to:

function as a foot when the luggage container is standing in a first orientation such that the wheel is not in contact with ground; and function as the hook when the luggage container is standing in a second orientation such that the wheel is in contact with the ground.

2. The luggage container of claim 1, further comprising a zipper configured to open or close the luggage container.

3. The luggage container of claim 2, wherein the zipper is positioned between two studs among the four studs and another two studs among the four studs.

4. The luggage container of claim 1, wherein a length of the gap is about 1 cm.

5. The luggage container of claim 1, wherein an outer side of the protrusion is shaped to be in contact with the ground when the luggage container is standing in the first orientation such that the stud-hook functions as the foot.

6. The luggage container of claim 1, wherein the stud-hook and other studs among the four studs always have different shapes.

7. The luggage container of claim 1, wherein the stud-hook is colored distinguishably from other studs among the four studs.

8. The luggage container of claim 1, wherein all of the four studs or feet are in contact with the ground when the luggage container is standing in the first orientation.

9. The luggage container of claim 1, wherein a shape of the stud-hook is fixed and not changeable.

10. The luggage container of claim 1, wherein a number of the stud-hook among the four studs is two.

11. The luggage container of claim 1, wherein a number of the stud-hook among the four studs is one.

12. The luggage container of claim 1, wherein the stud-hook is coupled to an upper portion of the narrow side surface of the luggage container standing in the second orientation.

13. The luggage container of claim 1, wherein the stud-hook is coupled to the narrow side surface by an adhesive.

14. The luggage container of claim 1, wherein the stud-hook is coupled to the narrow side surface via a hole formed on the narrow side surface such that a fastening means passes through the hole.

15. The luggage container of claim 1, wherein a visual image is formed on the stud-hook to indicate that the stud-hook is usable as the hook.

16. The luggage container of claim 15, wherein no visual image is formed on other studs.

* * * * *